US005820421A

United States Patent [19]

Makino

[11] Patent Number: 5,820,421

[45] Date of Patent: Oct. 13, 1998

[54] CONNECTOR WITH RETAINER INCLUDING CENTRAL, INTEGRALLY FORMED LOCKING STRIPS

[75] Inventor: Hirotaka Makino, Yokkaichi, Japan

[73] Assignee: Sumitomo Wiring Systems, Ltd., Yokkaichi, Japan

[21] Appl. No.: 843,005

[22] Filed: Apr. 11, 1997

[30] Foreign Application Priority Data

Jun. 26, 1996 [JP] Japan ..... 8-166257

[51] Int. Cl.[6] ..... H01R 13/436

[52] U.S. Cl. ..... 439/752

[58] Field of Search ..... 439/752, 595

[56] References Cited

U.S. PATENT DOCUMENTS 5,252,096 10/1993 Okada ..... 439/752
5,299,958 4/1994 Ohsumi ..... 439/752
5,516,308 5/1996 Yamanashi ..... 439/752

FOREIGN PATENT DOCUMENTS 5-144499 6/1993 Japan .
7-245143 9/1995 Japan .

*Primary Examiner*—Gary F. Paumen
*Attorney, Agent, or Firm*—Oliff & Berridge, PLC

[57] ABSTRACT

A retainer includes a retainer body and flexible locking strips for locking the retainer to a connector housing at a predetermined position. The retainer body has a plurality of through-holes through which terminals are inserted and a plurality of engaging portions each for preventing each terminal inserted into the connector housing from being moved in a return direction. The flexible locking strips form a part of each of front and rear walls of the retainer body.

14 Claims, 8 Drawing Sheets

CONNECTOR WITH RETAINER INCLUDING CENTRAL, INTEGRALLY FORMED LOCKING STRIPS

BACKGROUND OF THE INVENTION

1. Field of the Invention

The present invention relates to a retainer for preventing terminals inserted into a connector housing from being moved in a return direction.

2. Description of Related Art

An example of a conventional retainer will be described below with reference to FIG. 9. A retainer 1 comprises a plurality of through-holes 3 formed in parallel with each other on a body 2 of the retainer 1. A plurality of engaging portions 4 are formed at the front edge of the lower surface of each through-hole 3. A flexible locking strip 5F is formed at one end of the retainer body 2 in its right-to-left direction. A flexible locking strip 5R is formed at the other end of the retainer body 2 in its right-to-left direction. The retainer 1 is inserted upward from the bottom of the connector housing 6 into a retainer-accommodating chamber 7 formed inside a connector housing 6. As shown in FIG. 10, a claw 8 formed at the upper end of each of the flexible locking strips 5F and 5R engages each projection 9 formed on a wall of the retainer-accommodating chamber 7. In this manner, the retainer 1 is temporarily locked to the connector housing 6. Terminals are inserted into (unshown) respective cavities of the connector housing 6 to penetrate them through the respective through-holes 3, with each through-hole 3 mating each of the cavities formed in the connector housing 6. Then, the retainer 1 is pressed further upward into the retainer-accommodating chamber 7. As a result, each claw 8 engages the corresponding projection 9, thus locking the retainer 1 to the connector housing 6, with each engaging portion 4 engaging the corresponding terminal. In this manner, each terminal is retained in the connector housing 6 at the predetermined position.

The flexible locking strips 5F and 5R projecting upward from the retainer body 2 cause the height of the retainer 1 to be large by the height of the flexible locking strips 5F and 5R, thus causing the height of the connector housing 6 to increase by the height of the flexible locking strips.

SUMMARY OF THE INVENTION

The present invention has been made in view of the above situation. It is accordingly an object of the present invention to provide a compact retainer.

According to one aspect of the present invention, there is provided a retainer including a retainer body insertable into a connector housing into which terminals are inserted. The retainer body includes a plurality of through-holes through which terminals are inserted and a plurality of engaging portions each engaging a terminal inserted into the connector housing at a predetermined position thereof, thus preventing each terminal from being moved in a return direction. A plurality of flexible locking strips are provided for locking the retainer body to the connector housing at a predetermined position. In this construction, the height of each of the flexible locking strips is less than that of the retainer body.

Because the height of each of the flexible locking strips is smaller than that of the retainer body, the length of the retainer in the direction in which the retainer is inserted into the connector housing, namely, the height of the retainer is smaller than the conventional one. Accordingly, the vertical direction of the connector housing is smaller than that of the conventional one.

Each flexible locking strip may be in the shape of a cantilever, and a space which is open at a lower end surface of the retainer body may be formed below a lower end of each flexible locking strip by a metal mold. Each flexible locking strip may form a part of a wall constituting the through-holes.

A material can be molded into the flexible locking strips by using the metal mold which can be opened in the direction in which the flexible locking strips extend and the direction perpendicular to the direction in which the flexible locking strips extend. Therefore, the metal mold to be used to form the retainer of the present invention has a high design freedom, compared with the use of a metal mold which is opened only in the direction in which the flexible locking strips extend to shape the inner side of the flexible locking strip, and the upper and lower parts thereof are continuous with the upper and lower parts of the right or left end of each of the front and rear walls of the retainer.

Each flexible locking strip may form a part of a wall constituting the through-holes. Therefore, the retainer is short widthwise, compared with a retainer having flexible locking strips projecting widthwise therefrom.

According to another aspect of the present invention, there is provided a retainer assembly for securing terminals inserted within a connector housing, comprising a retainer body having at least one row of terminal receiving chambers for securely receiving the terminals; and a pair of cut-out portions integrally formed along a central portion of the retainer body, the cut-out portions defining respective locking strips engagable with the connector housing.

According to yet another aspect of the present invention, there is provided a retainer assembly comprising a connector housing; a retainer body having sidewalls insertable within the connector housing; and structure formed within the sidewalls of the retainer body for locking the retainer body to the connector housing at selected depths.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF PREFERRED EMBODIMENTS

The retainer according to a first embodiment of the present invention will be described below with reference to FIGS. 1 through 6.

Figure 1:
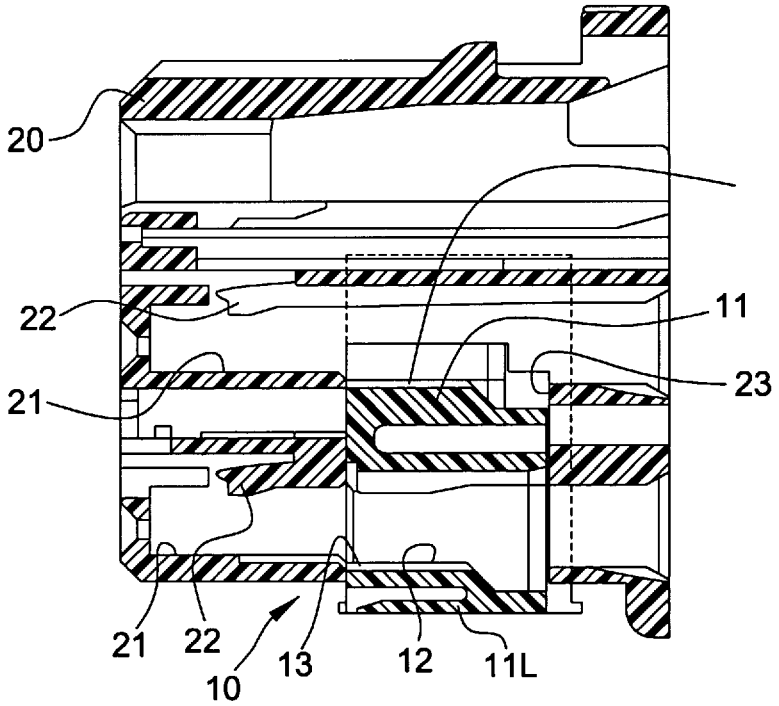
FIG. 1 is a sectional view showing a state in which a retainer, according to a first embodiment of the present invention, has been temporarily locked to a connector housing.
Figure 2:
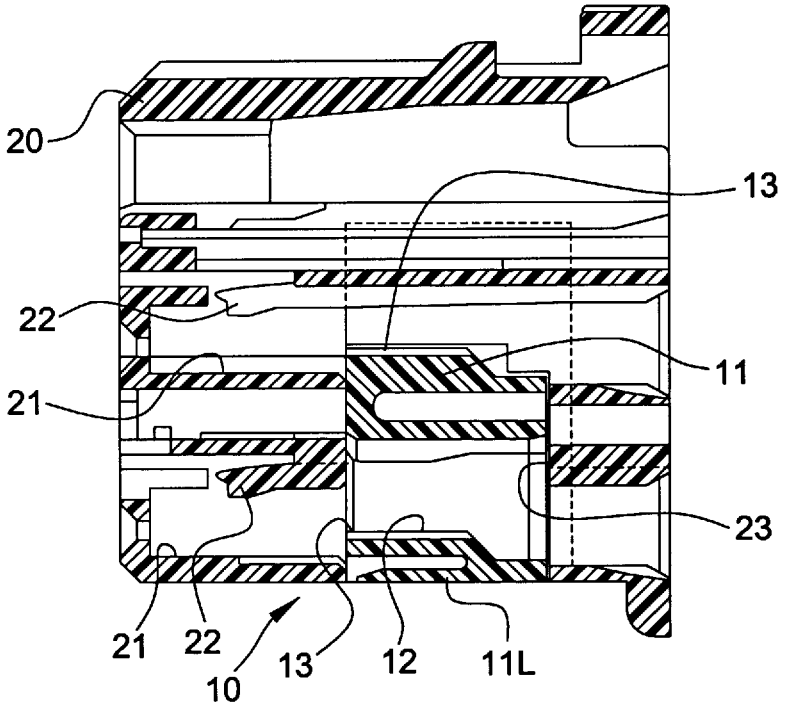
FIG. 2 is a sectional view showing a state in which the retainer of the first embodiment has been completely locked to the connector housing.
Figure 3:
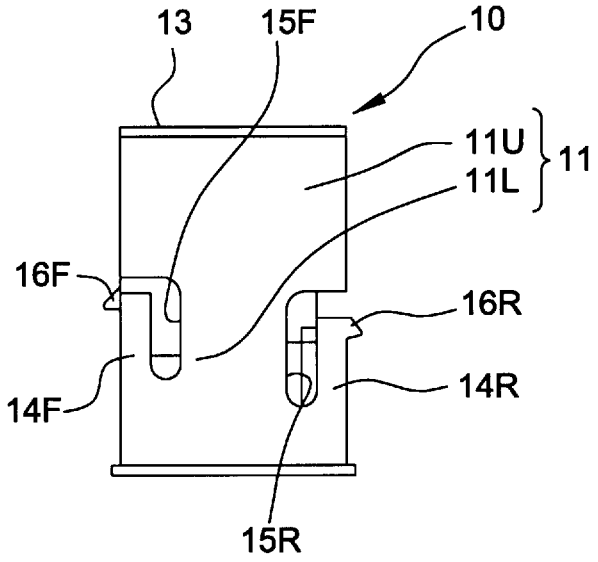
FIG. 3 is a side view showing the retainer of the first embodiment.

A connector housing 20 in which a retainer 10 of the first embodiment is mounted will be described below. As shown in FIGS. 1 and 2, the connector housing 20 has a plurality of cavities 21 formed in penetration therethrough in the front-to-back direction thereof. The cavities 21 are formed in three steps, for example, namely, an upper tier, a middle tier, and a lower tier. Eight cavities 21, for example, are formed at regular intervals on the intermediate and lower tiers in the right-to-left direction of the connector housing 20, whereas four unshown cavities 21 are formed on the upper tier in the right-to-left direction thereof, in such a manner that two cavities 21 are formed at each end in the right-to-left direction thereof. Metal terminals (unshown) are inserted forward into respective cavities 21 in a direction from the rear of the connector housing 20. When each terminal has been pressed forward to a predetermined position in each cavity 21, a lance 22 of each cavity 21 prevents the terminal from being moved backward.

In the connector housing 20, there is formed a retainer-accommodating chamber 23 into which the retainer 10 is inserted upward from the bottom of the connector housing 20. The retainer-accommodating chamber 23 is open at its lower surface and communicates with the respective cavities 21. When the retainer 10 has been inserted into the retainer-accommodating chamber 23, the retainer 10 engages the terminals inserted into the respective cavities 21 at the predetermined position thereof, thus preventing the terminals from being moved backward.

The construction of the retainer 10 will be described below.

The retainer 10 has a plurality of through-holes 12 formed in penetration through a body 11 in its front-to-back direction thereof; a plurality of engaging portions 13; and a pair of front and rear flexible locking strips 14F and 14R formed on the front and back walls thereof, respectively. The body 11 comprises a lower tier insertion section 11L and a pair of upper tier insertion sections 11U. Each of the eight through-holes 12 of the lower tier insertion section 11L mates the corresponding cavity 21 of the lower tier. The two through-holes 12 of one of a pair of the upper tier insertion sections 11U mate the two cavities 21 positioned at the right-hand side of the intermediate tier of the connector housing 20, whereas the two through-holes 12 of the other of the upper tier insertion sections 11U mate the two cavities positioned at the left-hand side of the intermediate tier. More specifically, the lower tier insertion section 11L has eight through-holes 12 penetrating therethrough in its front-to-back direction and mating the eight cavities 21 of the lower tier of the connector housing 20, respectively. Each upper tier insertion section 11U has two through-holes 12 formed in penetration therethrough in its front-to-back direction such that the right-hand two through-holes 12 mate the two cavities 21 positioned at the right-hand side of the intermediate tier of the connector housing 20, whereas the left-hand two through-holes 12 mate the two cavities 21 positioned at the left-hand side of the intermediate tier of the connector housing 20.

Figure 4:
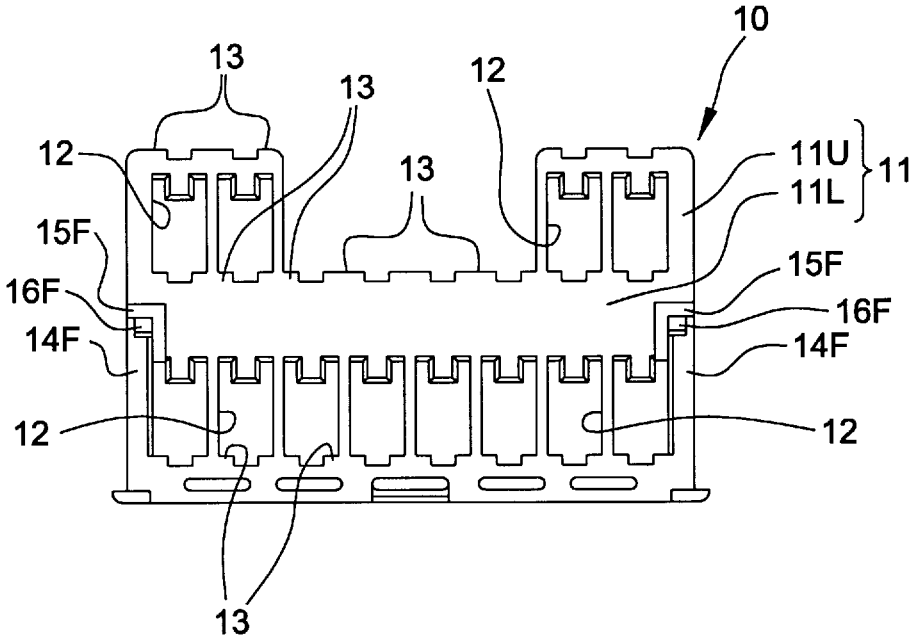
FIG. 4 is a front view showing the retainer of the first embodiment.

As shown in FIG. 4, one engaging portion 13 corresponding to each terminal is formed at the front end of the lower surface of each of the eight through-holes 12 (lower tier) and four through-holes 12 (intermediate tier). Four engaging portions 13 are formed at the front end of the upper surface of the lower tier insertion section 11L in correspondence to the respective cavities 21. Four engaging portions 13 are formed at the front end of the upper surface of the upper tier insertion section 11U in correspondence to the respective cavities 21. Each engaging portion 13 engages the lower surface of each terminal inserted into the predetermined position of each cavity 21, thus preventing it from moving backward.

The front and rear flexible locking strips 14F and 14R serve to selectively hold the retainer 10 at a temporary locking position and a complete locking position in the retainer-accommodating chamber 23. The front and rear flexible locking strips 14F and 14R form a part of the right or left end of each of the front and rear walls of the lower tier insertion section 11L of the body 11. A pair of front and rear inverted L-shaped cut-outs (slot portions) 15F and 15R is formed in each of the front and rear walls of the lower tier insertion section 11L such that the respective front and rear cut-outs 15F and 15R are open at the surface of each of the front and rear walls of the lower tier insertion section 11L so as to form a pair of the front flexible locking strips 14F on the front wall of the lower tier insertion section 11L and a pair of the rear flexible locking strips 14R on the rear wall thereof. The front and rear flexible locking strips 14F and 14R are cantilever-shaped, thus extending upward, namely, in the direction in which the retainer 10 is inserted into the retainer-accommodating chamber 23. As shown in FIG. 4, each of the front and rear cut-outs 15F and 15R penetrates through each of the cavities 21 positioned at the left and right ends of the eight cavities 21 of the lower tier of the connector housing 20. Thus, the front and rear flexible locking strips 14F and 14R flex elastically in the front-to-back direction of the retainer body 11.

The front flexible locking strip 14F (left-hand side in FIGS. 5 and 6) serves to temporarily lock the retainer 10 to the connector housing 20. A front temporary locking claw 16F projecting forward from the free (upper) end of the front flexible locking strip 14F engages a temporary locking projection 24 formed on the front wall of the retainer-accommodating chamber 23, with the front temporary locking claw 16F located above the temporary locking projection 24. The rear flexible locking strip 14R (right-hand side in FIGS. 5 and 6) serves to temporarily and completely lock the retainer 10 to the connector housing 20. A rear locking claw 16R projecting rearward from the free (upper) end of the rear flexible locking strip 14R engages a locking projection 25 formed on the rear wall of the retainer-accommodating chamber 23, with the rear locking claw 16R located below the locking projection 25 in the temporary locking state and above the locking projection 25 in the complete locking state.

Figure 5:
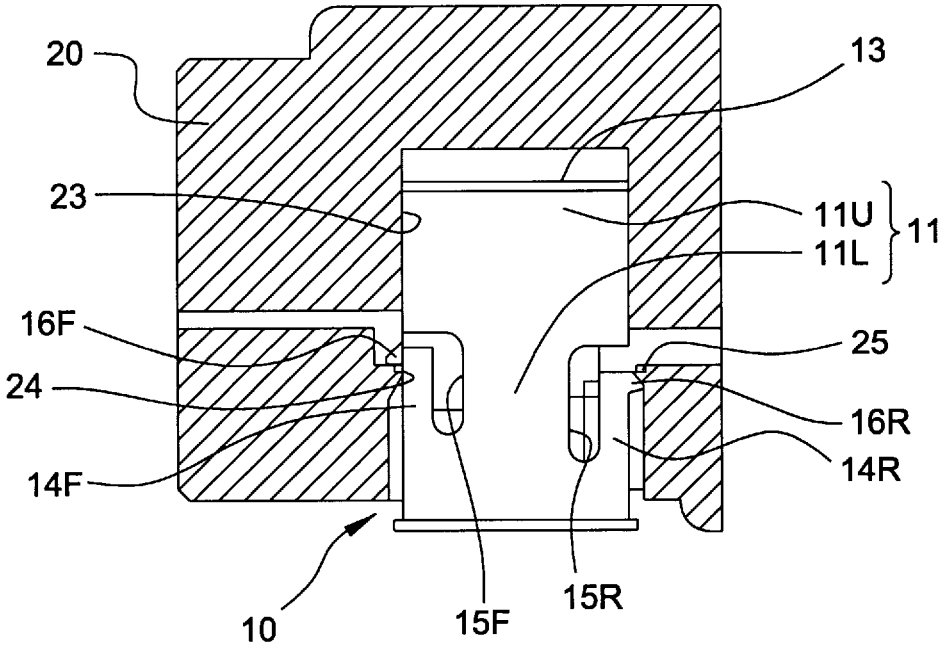
FIG. 5 is sectional view showing in detail a state in which flexible locking strips of the retainer of the first embodiment are at a temporary locking position in the connector housing.

The operation of the first embodiment is described below. The retainer 10 is inserted into the retainer-accommodating chamber 23 of the connector housing 20 to lock it to the connector housing 20 in the temporary locking state before terminals are inserted into the connector housing 20. When the retainer 10 is inserted upward into the retainer-accommodating chamber 23 from the lower surface of the connector housing 20, the front temporary locking claw 16F moves past the temporary locking projection 24 of the retainer-accommodating chamber 23, with the front flexible locking strip 14F elastically flexing backward. Then, the front flexible locking strip 14F restores elastically to the original state. As a result, the front temporary locking claw 16F engages the upper part of the temporary locking projection 24 and at the same time, the rear locking claw 16R of the rear flexible locking strip 14R engages the lower part of the locking projection 25. Consequently, as shown in FIGS. 1 and 5, the retainer 10 is held in the temporary locking state.

In the temporary locking state, the through-holes 12 of the lower tier insertion section 11L mate with the cavities 21 of the lower tier of the connector housing 20; the through-holes 12 of the upper tier insertion section 11U mate with the cavities 21 at the right and left ends of the intermediate tier of the connector housing 20; the upper surface of the lower tier insertion section 11L is positioned at the same level as that of bottom surface of the cavities 21 of the intermediate tier of the connector housing 20; the upper surface of the upper tier insertion section 11U is positioned at the same level as that of bottom surface of the cavities 21 of the upper tier of the connector housing 20; and each engaging portion 13 of the retainer 10 is flush with the bottom surface of each cavity 21. In this state, each terminal can be inserted into each cavity 21.

Figure 6:
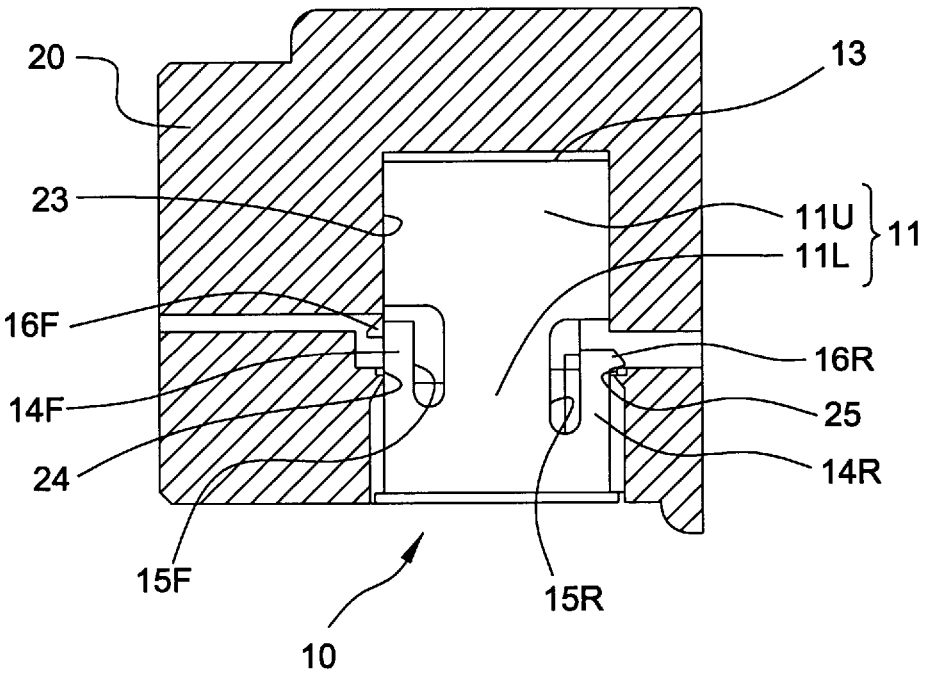
FIG. 6 is sectional view showing in detail a state in which the flexible locking strips of the retainer of the first embodiment are at a complete locking position in the connector housing.

In this state, each terminal (unshown) is inserted into each cavity 21 from the rear of the connector housing 20. After each terminal is inserted into each cavity 21 at the predetermined position thereof, the retainer 10 is pressed upward further. As a result, the rear locking claw 16R moves past the locking projection 25, with the rear flexible locking strip 14R flexing elastically inward (forward). When the rear flexible locking strip 14R is restored elastically to the original state, the rear locking claw 16R engages the upper part of the locking projection 25. Consequently, as shown in FIGS. 2 and 6, the retainer 10 is held in the complete locking state.

In the complete locking state, each engaging portion 13 of the retainer 10 engages the rear side of each terminal inserted into each cavity 21 at the predetermined position thereof, thus preventing the terminal from moving backward from the predetermined position in cooperation with the lance 22.

As described above, in the first embodiment, the front and rear flexible locking strips 14F and 14R for locking the retainer 10 at the temporary locking position and the complete locking position, respectively, form the lower part of the right or left end part of each of the front and rear walls of the lower tier insertion section 11L of the retainer body 11. Therefore, the height of the retainer 10 is smaller than that of the conventional retainer having the flexible locking strips projecting from the retainer body. Accordingly, the height of the retainer-accommodating chamber 23, namely, the height of the connector housing 20 is allowed to be smaller than that of the conventional connector housing. That is, the present invention provides the compact connector housing.

Also, because the front and rear flexible locking strips 14F and 14R do not project from the body 11, they can be prevented from being broken when they are handled.

In the first embodiment, the front and rear flexible locking strips 14F and 14R form a part of the right or left end part of each of the front and rear walls of the lower tier insertion section 11L. That is, the thickness of the front and rear flexible locking strips 14F and 14R is equal to that of the front and rear walls of the lower tier insertion section 11L. Accordingly, in the right-to-left direction of the retainer 10, the retainer 10 is smaller than that of a retainer having its flexible locking strips projecting forward and rearward from its front and rear walls. That is, in the front-to-back direction, the retainer 10 and the connector housing 20 are smaller than the conventional one, respectively.

If the front and rear flexible locking strips 14F and 14R are not cantilever-shaped, but if its upper and lower parts are continuous with the upper and lower parts of the right or left end of each of the front and rear walls of a retainer body, the locking claw of the flexible locking strip should be formed at its center so that it flexes in a possible greatest amount in order to allow the locking claw to lock the retainer to the connector housing reliably. In this case, the length between the fulcrum of the flexure of the flexible locking strip and the locking claw is half of its length. Therefore, the flexible locking strip of this construction flexes in a smaller amount than the cantilever-shaped one according to the first embodiment. Thus, in one preferred embodiment, it is desirable to make the flexible locking strip longer than the one according to the first embodiment to flex it sufficiently. Consequently, it is acceptable to form a large retainer.

Unlike the above-described construction, the front and rear locking claws 16F and 16R are formed at the free (upper) end of each of the front and rear flexible locking strips 14F and 14R in the form of a cantilever. Thus, even though the length of each of the front and rear flexible locking strips 14F and 14R is short, the front and rear locking claws 16F and 16R can be reliably flexed in the front-to-back direction of the retainer 10.

A second embodiment of the present invention will be described below with reference to FIGS. 7 and 8.

The constructions of the parts of the second embodiment are the same as those of the first embodiment except that the construction of the flexible locking strip of the second embodiment is different from that of the first embodiment. Thus, the constructions of the other constituting parts of the second embodiment corresponding to those of the first embodiment are denoted by the same reference numerals and the descriptions thereof are omitted herein.

The construction of a retainer 30 of the second embodiment is the same as that of the retainer 10 of the first embodiment in that the front and rear flexible locking strips 34F and 34R of the second embodiment are in the shape of a cantilever and form a part of each of the front and rear walls of the lower tier insertion section 11L. Straight front and rear cut-outs 35F and 35R open at the lower ends thereof are formed in the retainer 30 to form the front and rear flexible locking strips 34F and 34R extending downward, unlike the front and rear flexible locking strips 14F and 14R of the first embodiment extending upward. A space 37 open at the bottom surface of the retainer 30 is formed by a metal mold below the free (lower) end of the front flexible locking strip 34F and the front cut-out 35F and below the free (lower) end of the rear flexible locking strip 34R and the rear cut-out 35R.

The retainer 30 having the front and rear flexible locking strips 34F and 34R formed thereon is shaped by using a first pair of metal molds (unshown) which are opened vertically and a second pair of metal molds (unshown) which are opened in the front-to-back direction of the retainer 30. The lower metal mold of the second metal molds has a configuration corresponding to the vertical configuration of the inner side of the front and rear flexible locking strips 34F and 34R and the horizontal configuration of the free (lower) end thereof, whereas the upper metal mold of the second metal molds has a configuration corresponding to that of the upper surface of a front temporary locking claw 36F of the front flexible locking strip 34F, that of the upper surface of a rear locking claw 36R of the rear flexible locking strip 34R, and the vertical configuration of the outer side of the front and rear flexible locking strips 34F and 34R.

Figure 7:
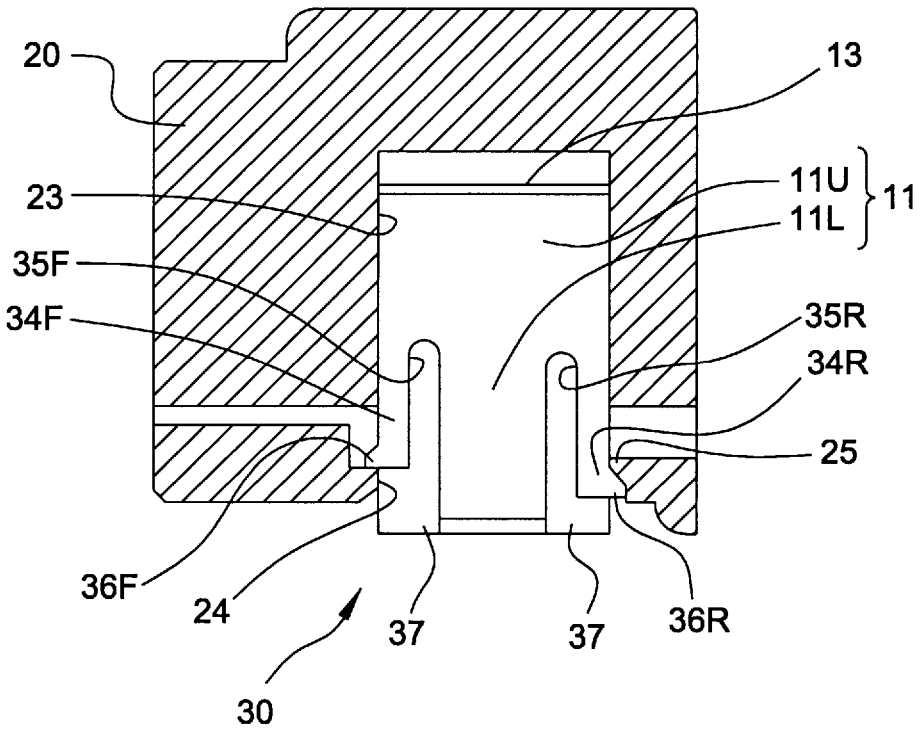
FIG. 7 is sectional view showing in detail a state in which flexible locking strips of the retainer of a second embodiment are at a temporary locking position in the connector housing.
Figure 8:
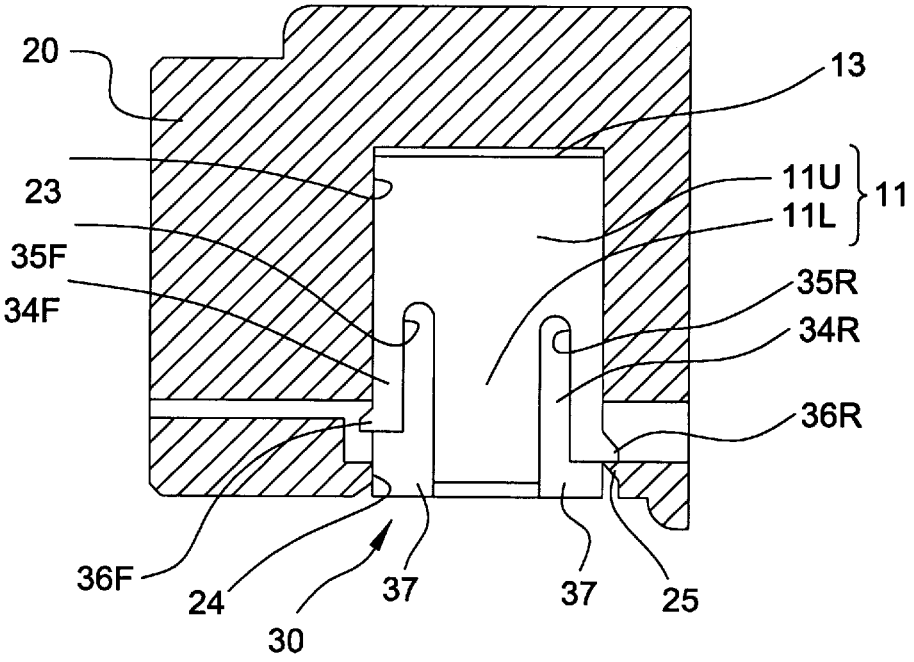
FIG. 8 is sectional view showing in detail a state in which the flexible locking strips of the retainer of the second embodiment are at a complete locking position in the connector housing.
Figure 9:
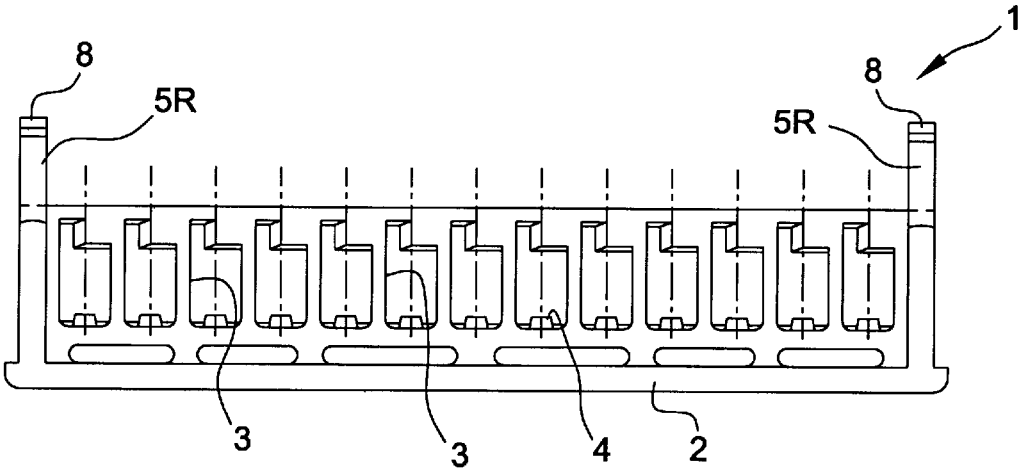
Figure 9 PRIOR ART
FIG. 9 is a front view showing a conventional retainer.
Figure 10:
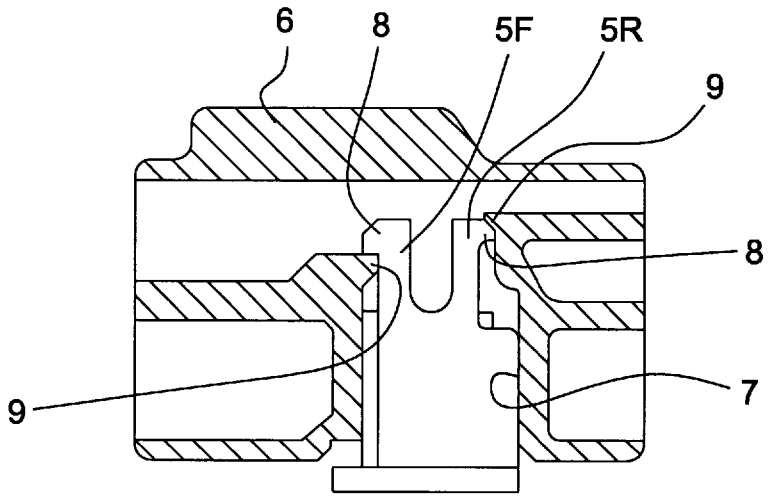
Figure 10 PRIOR ART
FIG. 10 is a sectional view showing a state in which the conventional retainer has been temporarily locked to a connector housing.

In molding a material into the retainer 30, it is unnecessary to use a pair of metal molds which are opened in the right-to-left direction of the retainer 30 perpendicular to the direction in which the front and rear flexible locking strips 34F and 34R extend (in the direction perpendicular to the surface of paper on which FIGS. 7 and 8 are drawn). That is, the retainer 30 is shaped by using the metal molds having a simple construction.

It is possible to use a metal mold which is opened in the right-to-left direction of the retainer 30 to shape the front and rear flexible locking strips 34F and 34R. In order to shape the flexible locking strips, the upper and lower parts of which are continuous with the upper and lower parts of the right or left end of each of the front and rear walls of a retainer, it is necessary to use a metal mold which is opened in the right-to-left direction of the retainer, whereas according to the present invention, the retainer 30 having the cantilever-shaped flexible locking strips formed thereon can be shaped by using a metal mold having higher design freedom.

The present invention is not limited to the above-described embodiments, but an embodiment which is described below is included in the technical scope of the present invention. In addition, various changes and modifications other than the embodiment which is described below may be made without departing from the gist of the present invention.

(1) In the first and second embodiments, the retainer to be applied to the connector housing has been described in which cavities are formed in three tiers. In addition, it is possible to apply the retainer of the present invention to a connector housing having a single tier on which cavities are arranged in a row and those having two tiers or more than three tiers on which cavities are arranged.

When cavities are formed in one or two tiers in the connector housing to which the retainer is applied, the upper tier insertion section is removed from the retainer body. But each of the flexible locking strips does not project upward from each of the front and rear walls of the retainer body because the height of each of the flexible locking strips is a part of each of the entire front and rear walls of the lower tier insertion section.

(2) In the first and second embodiments, the thickness of each of the flexible locking strips is equal to that of the front and rear walls of the lower tier insertion section. But it is possible to form the front and rear flexible locking strips by projecting them forward and rearward, respectively from each of the front and rear walls of the retainer body.

(3) In the second embodiment, the front flexible locking strip is formed on the right and left ends of the front wall of the retainer body, and the rear flexible locking strip is formed on the right and left ends of the rear wall thereof. But it is possible to form the front and rear flexible locking strips on the front and rear of partitioning walls between adjacent through-holes. In this case, the free (lower) end of each flexible locking strip is also open at the lower surface of the connector housing. Therefore, there is no inconvenience in molding a material into the retainer by means of metal mold.

(4) In the second embodiment, as a means for molding a material into the retainer, a pair of the first metal molds which are opened vertically and a pair of the second metal molds which are opened in the front-to-back direction of the retainer are used. In addition, it is possible to use a pair of the second metal molds and another type metal mold including a lower one which is opened downward. In this case, a pair of the second metal molds has a configuration corresponding to the upper surface of the retainer.

(5) It is also possible to form but one cut-out portion to define a single cantilevered locking arm that engages with one, two or more projections formed along a common wall within the connector housing at depths selected to coincide with the temporary and permanent terminal locking positions.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims.

What is claimed is:

1. A retainer assembly, comprising:

a connector housing structured to receive terminals in a first direction;

a retainer body insertable into the connector housing in a second direction perpendicular to the first direction, said retainer body including a plurality of through-holes through which the terminals are inserted and a plurality of engaging portions for engaging respective ones of said terminals inserted into the connector housing; and a plurality of flexible locking strips at each end of the retainer body that lock the retainer body to the connector housing at a predetermined position, wherein each of the flexible locking strips is in the shape of a cantilever, and wherein each of the flexible locking strips forms a part of a wall forming a respective one of the through-holes.

2. The retainer assembly according to claim 1, wherein a space that is open at a lower end surface of the retainer body is formed below a lower end of each of the flexible locking strips.

3. The retainer assembly according to claim 1, wherein a height of each of the flexible locking strips is less than that of the retainer body.

4. A retainer assembly for securing terminals inserted within a connector housing, comprising:

a retainer body having at least one row of terminal receiving chambers for securely receiving said terminals; and a pair of slot portions integrally formed along a central portion of walls at each end of said retainer body, said slot portions defining respective locking strips engagable with the connector housing. that lock the retainer body to the connector housing at a predetermined position.

5. The retainer assembly according to claim 4, wherein said slot portions extend from an exterior surface of the retainer body toward said central portion.

6. The retainer assembly according to claim 4, wherein said slot portions are L-shaped portions that extend from said central portion of said retainer body and terminate prior to reaching an exterior surface of the retainer body.

7. The retainer assembly according to claim 4, wherein said pair of slot portions are asymmetrical with respect to one another.

8. The retainer assembly according to claim 4, wherein one of said locking strips is positioned at a height different than that of another of said locking strips.

9. The retainer assembly according to claim 4, wherein a first one of said locking strips includes a first locking claw engagable with the connector housing at a first distance within the connector housing, and a second one of the locking strips includes a second locking claw engagable with the connector housing at a second distance within the connector housing, said first and second distances being different from one another.

10. The retainer assembly according to claim 9, wherein the first locking claw fixes the retainer body in the connector housing at a temporary lock position, and the second locking claw fixes the retainer body in the connector housing at a permanent lock position.

11. A retainer assembly comprising:

a connector housing;

a retainer body having a pair of sidewalls insertable within the connector housing; and means formed within the sidewalls of the retainer body for locking the retainer body to the connector housing at selected depths wherein said means for locking includes a pair of slot portions formed centrally in each of said pair of sidewalls of said retainer body.

12. The retainer assembly according to claim 11, wherein said means for locking further includes cantilevered locking claws that flex into said slot portions while being positioned at said selected depths.

13. The retainer assembly according to claim 11, wherein said slot portions extend from an external surface of the retainer body flush with the connector housing toward an interior portion of the connector body.

14. The retainer assembly according to claim 10, wherein said each of the slot portions comprises an L-shaped groove open to an internal side wall of the retainer body.

* * * * *